US011460021B2

(12) United States Patent
Buskirk et al.

(10) Patent No.: US 11,460,021 B2
(45) Date of Patent: Oct. 4, 2022

(54) FLUID DELIVERY SYSTEM AND METHOD

(71) Applicant: MATTHEWS INTERNATIONAL CORPORATION, Pittsburgh, PA (US)

(72) Inventors: William A. Buskirk, Albany, OR (US); Thomas E. Kimerling, Beaverton, OR (US); Charles Gilson, Philomath, OR (US); Phillip J. Young, Albany, OR (US); Kirk Hall, Corvallis, OR (US); Detlef Mueller, Corvallis, OR (US)

(73) Assignee: Matthews International Corporation, Pittsburgh, PA (US)

( * ) Notice: Subject to any disclaimer, the term of this patent is extended or adjusted under 35 U.S.C. 154(b) by 114 days.

(21) Appl. No.: 16/627,039

(22) PCT Filed: Jun. 29, 2018

(86) PCT No.: PCT/US2018/040345

§ 371 (c)(1),
(2) Date: Dec. 27, 2019

(87) PCT Pub. No.: WO2019/006338

PCT Pub. Date: Jan. 3, 2019

(65) Prior Publication Data

US 2020/0132066 A1 Apr. 30, 2020

Related U.S. Application Data

(60) Provisional application No. 62/526,679, filed on Jun. 29, 2017.

(51) Int. Cl.

| | |
|---|---|
| ***F04B 43/12*** | (2006.01) |
| ***F04B 23/02*** | (2006.01) |
| ***F04B 49/08*** | (2006.01) |
| ***B41J 2/175*** | (2006.01) |

(52) U.S. Cl.

CPC ..... *F04B 43/12* (2013.01); *B41J 2/175* (2013.01); *B41J 2/17596* (2013.01); *F04B 23/025* (2013.01); *F04B 49/08* (2013.01)

(58) Field of Classification Search

CPC ..... F04B 23/025; F04B 49/08; F04B 43/12; F04B 49/065; B41J 29/38; B41J 2/18; B41J 2/17596; B41J 2/1721; B41J 2002/1735

See application file for complete search history.

(56) References Cited

U.S. PATENT DOCUMENTS

| | | | |
|---|---|---|---|
| 333,088 | A | 12/1885 | Diggins |
| 4,135,647 | A | 1/1979 | Mascia |
| 4,357,617 | A | 11/1982 | Shimazawa et al. |
| 4,610,313 | A | 9/1986 | Daly et al. |
| 4,661,093 | A | 4/1987 | Beck et al. |
| 2010/0047099 | A1 | 2/2010 | Miyazaki et al. |
| 2010/0201761 | A1 | 8/2010 | Lu et al. |

(Continued)

FOREIGN PATENT DOCUMENTS

| | | | |
|---|---|---|---|
| DE | 19910022 | A1 | 4/2000 |
| EP | 0128388 | A2 | 12/1984 |

(Continued)

*Primary Examiner* — An H Do

(74) *Attorney, Agent, or Firm* — DLA Piper LLP

(57) ABSTRACT

Disclosed herein is a fluid supply system that can provide fluid to a jetting assembly at a constant pressure or at pressures within a desired range of pressures. In an example, the fluid can be ink, and the jetting assembly can be a print head configured for dispensing the ink.

16 Claims, 6 Drawing Sheets

(56) References Cited

U.S. PATENT DOCUMENTS

| | | | |
|---|---|---|---|
| 2013/0220461 | A1 | 8/2013 | Shigeta et al. |
| 2014/0333703 | A1 | 11/2014 | Buskirk et al. |

FOREIGN PATENT DOCUMENTS

| | | | |
|---|---|---|---|
| EP | 0375383 | A1 | 6/1990 |
| GB | 1534015 | A | 11/1978 |
| JP | 58-10186 | A | 1/1983 |
| JP | 60-175896 | A | 11/1985 |
| JP | 2001037544 | A | 2/2001 |
| JP | 201735654 | A | 2/2017 |
| WO | 2007092618 | A2 | 8/2007 |
| WO | 2012154603 | A1 | 11/2012 |
| WO | 2019006338 | A1 | 1/2019 |

FLUID DELIVERY SYSTEM AND METHOD

CROSS REFERENCE TO RELATED APPLICATIONS

This application is a U.S. National Stage filing under 35 U.S.C. § 371 of International PCT Application No. PCT/US2018/040345 filed on Jun. 29, 2018, which claims priority to U.S. Provisional Application No. 62/526,679 entitled "Fluid Delivery System and Method" filed on Jun. 29, 2017, each of which is incorporated by reference herein in its entirety.

BACKGROUND

Disclosed herein is a fluid supply system that can provide fluid to a jetting assembly at a constant pressure or at pressures within a desired range of pressures. In an example, the fluid can be ink, and the jetting assembly can be a print head configured for dispensing the ink. In an example, the jetting assembly can be a single micro-valve of the type disclosed in U.S. Patent Application Publication No. 2014/0333703 or an array of said micro-valves.

Prior art fluid supply systems suffer the drawback that it is difficult to adjust the pressure to improve the firing performance of the jetting assembly. Furthermore, prior art fluid supply systems cannot operate in a fashion where fluid supply sources or cartridges can be swapped while the system continues printing, without shutting down or affecting print operation.

In the fluid supply system described herein, the pressure can be adjusted to different values to modify the firing performance of the jetting assembly. Fluid supply cartridges can be swapped while the system is printing without affecting the print operation. The system can be primed from a dry condition. These and other advantages are achieved with the embodiments described herein.

SUMMARY

In one embodiment, a fluid supply system comprises a variable volume accumulator configured to receive a fluid from a fluid supply source; and a pump for transferring the fluid from the fluid supply source into the variable volume accumulator. The variable volume accumulator is configured to output the fluid between a first pressure and a second pressure to a jetting assembly.

In another embodiment, when outputting the fluid at the first pressure, the variable volume accumulator holds a first volume of the fluid, and when outputting the fluid at the second pressure, the variable volume accumulator holds a second volume of the fluid. The second volume of the fluid is less than the first volume of the fluid, and the first pressure is greater than the second pressure.

In another embodiment, the volume of the variable volume accumulator increases in response to the transfer of the fluid into the variable volume accumulator.

In another embodiment, the volume of the variable volume accumulator decreases in response to outputting the fluid to the jetting assembly.

In another embodiment, the fluid supply source is a replaceable fluid supply source, and the jetting assembly operates uninterrupted during replacement of the replaceable fluid supply source.

In another embodiment, the fluid supply source is a replaceable fluid supply source, and the variable volume accumulator is capable of supplying all of the fluid required for normal operation of the jetting assembly during the time required to replace the replaceable fluid supply source.

In one embodiment, a fluid supply system includes a peristaltic pump that transfers a fluid by pushing the fluid through a compressible tube and a replaceable fluid supply source that includes the fluid. The compressible tube is associated with the replaceable fluid supply source such that it is removed from the fluid supply system when the replaceable fluid supply source is replaced.

In another embodiment, the fluid supply system includes a jetting assembly that operates uninterrupted during replacement of the replaceable fluid supply source.

In another embodiment, the fluid supply system includes a jetting assembly and a variable volume accumulator configured to receive the fluid from the replaceable fluid supply source.

In another embodiment, an amount of the fluid within the replaceable fluid supply source is less than or equal to an amount of fluid usable during a wear lifetime of the compressible tube.

In one embodiment, a method of supplying fluid comprises transferring a fluid with a pump from a fluid supply source into a variable volume accumulator that is configured to receive a fluid from the fluid supply source; and outputting, from the variable volume accumulator to a jetting assembly, the fluid at a pressure between a first pressure and a second pressure to a jetting assembly, wherein the first pressure is greater than the second pressure.

In another embodiment, when outputting the fluid at the first pressure, the variable volume accumulator holds a first volume of the fluid. When outputting the fluid at the second pressure, the variable volume accumulator holds a second volume of the fluid, and the second volume of the fluid is less than the first volume of the fluid.

In another embodiment, the fluid supply source is a replaceable fluid supply source, and the method further comprises replacing the replaceable fluid supply, and operating the jetting assembly uninterrupted during the replacing of the replaceable fluid supply.

In one embodiment, a method of supplying fluid includes providing a peristaltic pump and a replaceable fluid supply source that includes a fluid, and transferring the fluid using the peristaltic pump by pushing the fluid through a compressible tube. The compressible tube is associated with the replaceable fluid supply source such that it is removed from the fluid supply system when the replaceable fluid supply source is replaced.

In another embodiment, the method further comprises replacing the replaceable fluid supply source.

In another embodiment, the method further comprises operating the jetting assembly uninterrupted during the replacing of the replaceable fluid supply.

DETAILED DESCRIPTION

Figure 1:
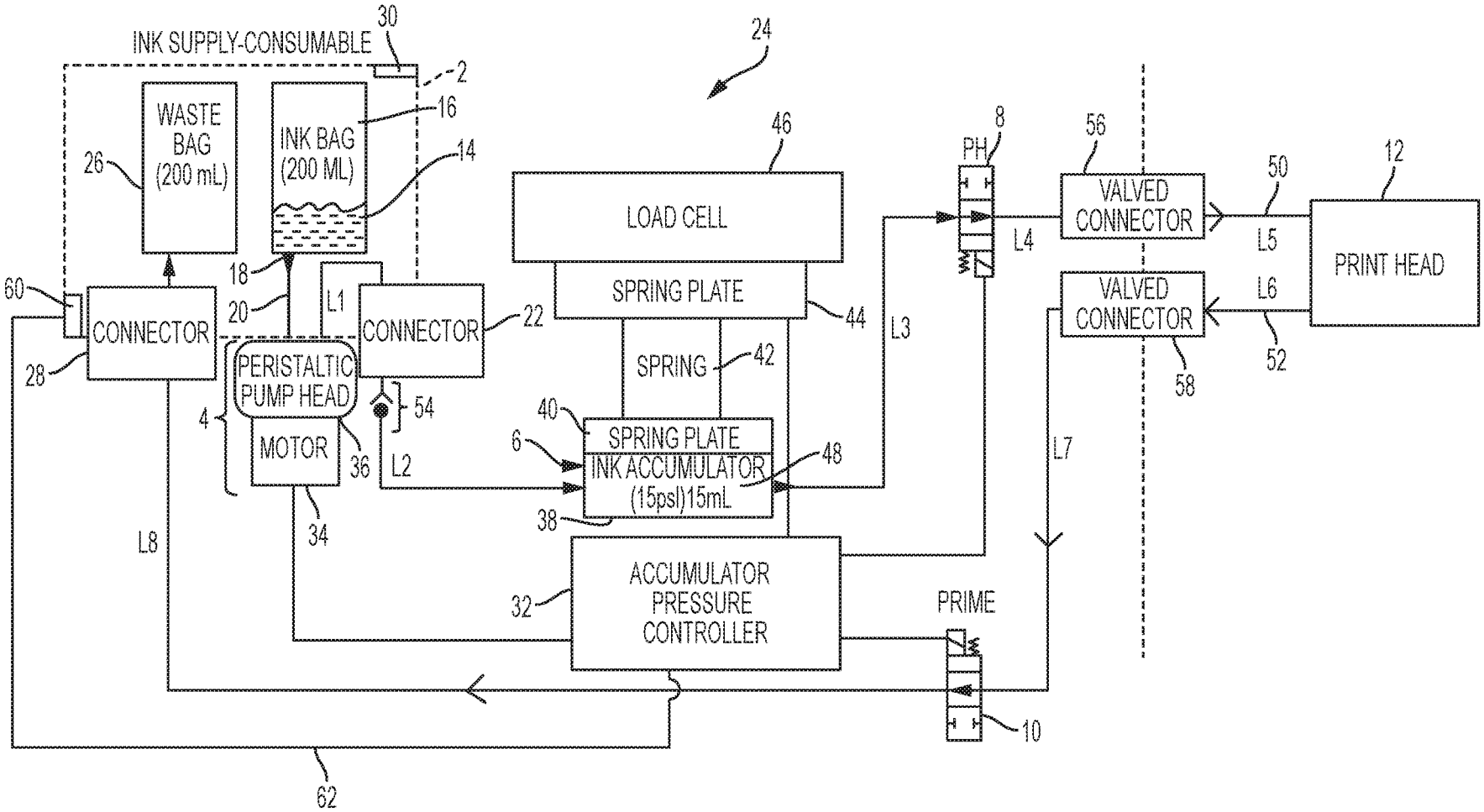
FIG. 1 depicts an illustrative fluid supply system according to an embodiment.

Before the present products, devices, apparatus, methods, and uses are described, it is to be understood that this invention is not limited to the particular processes, compositions, or methodologies described, as these may vary. It is also to be understood that the terminology used in the description is for the purpose of describing the particular versions or embodiments only, and is not intended to limit the scope of the present invention, which will be limited only by the appended claims. Unless defined otherwise, all technical and scientific terms used herein have the meaning commonly understood by one of ordinary skill in the art. Although any methods and materials similar or equivalent to those described herein can be used in the practice or testing of embodiments of the present invention, the preferred methods, devices, and materials are now described. All publications mentioned herein are incorporated by reference in their entireties. Nothing herein is to be construed as an admission that the invention is not entitled to antedate such disclosure by virtue of prior invention.

Various non-limiting examples will be described with reference to the accompanying figures where like reference numbers correspond to like or functionally equivalent elements.

For the purposes of the description hereinafter, the terms "end," "upper," "lower," "right," "left," "vertical," "horizontal," "top," "bottom," "lateral," "longitudinal," and derivatives thereof shall relate to the example(s) as oriented in the drawing figures. However, it is to be understood that the example(s) may assume various alternative variations and step sequences, except where expressly specified to the contrary. It is also to be understood that the specific example(s) illustrated in the attached drawings, and described in the following specification, are simply exemplary examples or aspects of the invention. Hence, the specific example(s) or aspect(s) disclosed herein are not to be construed as limiting.

It must also be noted that as used herein and in the appended claims, the singular forms "a," "an," and "the" include plural references unless the context clearly dictates otherwise. Thus, for example, reference to "a combustion chamber" is a reference to "one or more combustion chambers" and equivalents thereof known to those skilled in the art, and so forth.

Throughout the specification, when terms are described in the singular, it is meant that the term encompasses both the singular element and plurality of the claim elements. For example, a description of "the jetting assembly" means that in some embodiments, there is a single jetting assembly, but that in other embodiments, there is more than one jetting assembly.

As used herein, the term "about" means plus or minus 10% of the numerical value of the number with which it is being used. Therefore, about 50% means in the range of 45%-55%.

System Components

With reference to FIG. 1, an example fluid supply system can include the following components: a replaceable fluid supply source or cartridge 2, a pump 4; an accumulator 6; and one or more fluid control valves 8 and 10 that provide fluid to a jetting assembly or print head 12. In an example, the pump 4 can be a peristaltic pump. Hereinafter, the pump 4 will be described as being a peristaltic pump. However, this is not to be construed in a limiting sense.

The fluid supply cartridge 2 can be a replaceable component. In an example, the fluid supply cartridge 2 can include a fluid 14 held, for example, in a sealed container 16 at ambient pressure. In an example, the sealed container 16 can be collapsible bag. However, this is not to be construed in a limiting sense.

The fluid 14 can exit sealed container 16 through a connector or fitment 18 and move through a compressible tube 20 that runs through the peristaltic pump 4 to a connector or fitment 22 that connects the fluid supply cartridge 2 to the accumulator 6.

The fluid supply cartridge 2 can include a second "waste" fluid container or diaper 26 that can collect waste fluid from the system via a connector or fitment 28. In an example, each fitment 22 and 28 can be a needle/septum combination when the fluid supply cartridge 2 is not installed on the fluid supply system. The fluid supply cartridge 2 can include an ID chip 30 that can be configured to provide information to a processor or controller 32 about the type and volume of fluid 14, its date of manufacture, preferred operating parameters, etc. As the fluid 14 in the container 16 is used, the amount of fluid used can be recorded by the processor or controller 32 in the ID chip 30.

Peristaltic pumps 4 are well known in the art. A peristaltic pump 4 includes two primary parts, namely, a compressible tube 20 that feeds fluid 14 to an accumulator 6 and a motor driven pump head 36 (driven by motor 34). The motor driven pump head 36 includes a roller or shoe (not shown) that presses on the compressible tube 20 and pushes the fluid 14 along the tube toward the accumulator 6 as the at least one roller or at least one shoe moves along the length of the compressible tube. In some embodiments, the interior chamber of the peristaltic pump 4 may include a fluid, such as oil or grease, that is used to protect, lubricate, or cool the compressible tube 20. Peristaltic pumps are known in the prior art and will not be described in detail herein for simplicity.

The compressible tube 20 is a primary wear component of the fluid supply system due to its interaction with the peristaltic pump 4 and the fluid 14 therein. Therefore, in some embodiments, the compressible tube 20 may be located or associated with the fluid supply cartridge or fluid supply source 2. In some particularly useful embodiments, the fluid supply cartridge or fluid supply source 2 may be replaceable and, when replaced, may result in the replacement of the compressible tube as well. In further embodiments, the fluid capacity of the fluid supply cartridge or fluid supply source 2 is selected so that it is less than or equal to an amount of fluid processed in a wear lifetime of the compressible tube 20. As an example, if the compressible tube 20 is expected to withstand the pumping of one liter of fluid 14 before degrading and having the potential to fail, then the fluid capacity of the fluid supply source 2 may be one liter or less. In some embodiments, when the fluid supply cartridge 2 is installed on the system, the rollers of the pump head 36 push against and along the length of the compressible tube 20 in the direction of the accumulator 6 which creates the full pump assembly.

In some embodiments, the accumulator 6 can be an enclosed, variable volume 48 with one or more fixed walls 38 and at least one moveable wall 40. Moveable wall 40 can be biased toward the one or more fixed walls 38 by one or more spring(s) 42. The end(s) 44 of the spring(s) 42 opposite the moveable wall 40 can be biased on and press against a load cell 46 that can measure a force being applied by the spring(s) and can supply an indication of said measured force to the processor or controller 32. As the amount of fluid 14 in the accumulator 6 increases, the moveable wall 40 moves away from the one or more fixed walls 38 increasing the force that the spring(s) 42 applies on the load cell 46. The pressure of fluid 14 in the accumulator 6 can be determined by converting the output of the load cell 46 into a force that the spring(s) 42 is/are applying to the load cell and knowing the area of the surface of the fluid 14 in contact with the moveable wall 40, e.g., pressure=force/area.

As is known in the art, the load cell 46 outputs an analog signal having a value corresponding to the force applied to the load cell 46 by the spring(s) 42. In an example, this analog signal can be converted via an analog-to-digital converter into a digital equivalent value that can be processed by the processor or controller 32. The processor or controller 32 can compare this digital equivalent value to lower and upper set point force values stored in a memory of the processor or controller and can control the operation of the motor 34 based on this comparison in a manner such as is described hereinafter.

In some embodiments, inlet and exit fluid control valves 8 and 10, respectively, allow the fluid 14 to flow to and return from the jetting assembly 12 via fluid connectors 56 and 58. In an example, each fluid control valve 8 and 10 can be a binary (open/closed) valve that is compatible with the type of fluid 14 being used.

In some embodiments, the fluid 14 can be supplied to the jetting assembly 12 at a constant pressure or at pressures within a desired range of pressures (e.g., corresponding to lower and upper set point force values stored in the memory of the processor or controller 32). In some embodiments, the desired range of pressures corresponds to those pressures between a first pressure and a second pressure, where the first pressure is greater than the second pressure. During operation of some embodiments, the pressure of fluid 14 in the accumulator 6 when the accumulator is full corresponds to the first pressure, which is the highest pressure. Furthermore, the pressure of fluid 14 in the accumulator 6 when the accumulator 6 is empty or approaches empty corresponds to a second pressure, which is the lowest pressure. In such embodiments, the first pressure is greater than the second pressure. While the jetting assembly 12 is described herein as being a print head which dispenses a fluid 14, such as ink, this is not to be construed in a limiting sense (i.e., the fluid can be something other than ink).

Starting from a dry state, the jetting assembly 12 can be primed by allowing the fluid 14 to enter through a first fluid port 50 and exit out of a second fluid port 52. Details regarding the jetting assembly 12 will not be described further herein.

System Operation

In an initial state, the accumulator 6 is dry, and the system includes no fluid supply cartridge 2. To initiate operation, a fluid supply cartridge 2 is coupled to the system via fitments 22 and 28. This coupling engages the compressible tube 20 of the fluid supply cartridge 2 with the roller assembly of the pump head 36 and connects the sealed fluid container 16 of the supply cartridge to the accumulator 6.

The system processor or controller 32 can detect that the fluid supply cartridge 2 has been installed, e.g., via a contact 60 on a body of the fluid supply cartridge, and can determine, via the output of a load cell 46, that the accumulator 6 is below a desired operating pressure. In response, the processor or controller 32 can turn on a motor 34 causing the pump head 36 to pump the fluid 14 from the sealed container 16 into the accumulator 6 via a check valve 54. The processor or controller 32 can monitor the output of the load cell 46 and, when a force measured by the load cell reaches a desired operating value corresponding to a desired volume of fluid 14 in the volume 48 of the accumulator 6, the processor or controller can cause the motor 42 to turn off stopping the flow of fluid into the accumulator.

To prime the jetting assembly 12, both the inlet fluid control valve 8 and the exit fluid control valve 10 are opened. This allows the fluid 14 from the accumulator 6 to flow through the jetting assembly 12 and back to the fluid supply cartridge 2. More specifically, the "waste" fluid 14 that flows through the exit fluid control valve 10 flows to a "waste" fluid container 26 of the fluid supply cartridge 2.

Under the control of the processor or controller 32, the motor 34 can be turned on and off as the fluid 14 flows out of (exits) the accumulator 6, replacing it with more fluid from the sealed container 16 of the fluid supply cartridge 2, to maintain a desired level and pressure of the fluid in the volume 48 of the accumulator.

Once the accumulator 6 is primed with fluid 14, the exit fluid control valve 10 is closed. The pressure in the accumulator 6 is now applied directly to the jetting assembly 12 and the fluid supply system is in its operational state.

During operation of the fluid supply system, the fluid 14 is "consumed" by the jetting assembly 12 in a manner known in art and will not be described further herein. Under the control of the processor or controller 32, as the fluid 14 flows out of the accumulator 6, the moveable wall 40 moves toward the one or more fixed walls 38, reducing the force applied by the spring(s) 42 on the load cell 46. When the processor or controller 32 detects that the force on the load cell 46 has fallen below the lower set point force value corresponding to a minimum pressure of the fluid 14 in the variable volume 48 of the accumulator 6, the processor or controller can turn on the motor 34 whereupon the pump head 36 pumps the fluid into the accumulator, moving the moveable wall 40 away from the one or more fixed walls 38 and the compressing spring(s) 42. This lower set point value may correspond to the second pressure. When the processor or controller 32 determines that the force applied by the spring(s) 42 on the load cell 46 has reached the upper set point force value, the motor 34 is turned off. This upper set point value may correspond to the first pressure. The upper and lower set point force values (and first and second pressures, respectively) are selected to allow the pressure of the fluid 14 in the accumulator 6 to remain in a range of pressures needed for proper operation of the jetting assembly 12. By changing one or both of force set point values programmed in the processor or controller 32, a different operating pressure or a different range of operating pressures of the fluid 14 in the accumulator 6 can be obtained.

In an example, the lower and upper set point force values can be the same, whereupon the processor or controller 32 causes the motor 34 to turn on and off in a manner to maintain the pressure of the fluid 14 in the accumulator 6 at a constant or substantially constant value. However, this is not to be construed in a limiting sense since it is envisioned that the lower and upper set point force values can be selected to allow the pressure of the fluid 14 in the accumulator 6 to vary from a desired lower pressure and a desired upper pressure, e.g., within a desired range of pressures suitable for the intended operation of the jetting assembly 12 dispensing a certain type of fluid 14. In other examples, the upper set point value can be greater than the lower set point force values, corresponding to a range of permissible pressures.

As the fluid 14 is being used by the jetting assembly 12, it is being depleted from the sealed container 16 of fluid the supply cartridge 2. When the processor or controller 32 determines that the amount of fluid 14 remaining in the sealed container 16 falls below a low fluid set level, the processor or controller can output a suitable operator discernable notice and cause the motor 34 to turn off or remain off, whereupon the pump head 36 is not pumping the fluid 14 and the current fluid supply cartridge 2 can be removed and replaced with a new fluid supply cartridge 2 that includes a full charge of fluid 14.

Even when the motor 34 is off and the pump head 36 is not pumping the fluid 14, the fluid can still flow under pressure from the accumulator 6 to the jetting assembly 12 until a level of fluid 14 in the accumulator 6 falls, and the force that the spring(s) 42 applies to the load cell 46 drops below the lower set point force value.

In an example, the accumulator 6 and the spring(s) 42 can be sized such that sufficient time is provided to replace a depleted fluid supply cartridge 2 with a new fluid supply cartridge 2 in the sealed container 16 before the pressure of the fluid 14 in the accumulator 6 drops below a desired lower pressure for the supply of the fluid to the jetting assembly. In an example, this desired lower pressure can correspond to the lower set point force value or can be lower (in the case where the replacement of the fluid supply cartridge 2 begins when the force measured by the load cell 46 corresponds to or is slightly above the lower set point force value).

By sizing the volume 48 of the accumulator 6 correctly, any reasonable time to replace a fluid supply cartridge 2 depleted of fluid 14 with one having a full charge of fluid can be accommodated (minutes to hours). Once a new fluid supply cartridge 2 that includes a full charge of fluid 14 in its sealed container 16 is inserted, the motor 34 and the pump head 36 can be operated normally under the control of the processor or controller 32.

To replace the jetting assembly 12, the inlet fluid control valve 8 is closed, and the exit fluid control valve 10 is opened, whereupon "waste" fluid 14 flows out of the jetting assembly and into the "waste" fluid container 26. The jetting assembly 12 can now be replaced in an unpressurized state. When a new jetting assembly 12 is installed, the inlet fluid control valve 8 and the exit fluid control valve 10 are opened, and the fluid 14 flows through the new jetting assembly and pushes any air that may be in the new jetting assembly into the "waste" fluid container 26. Once primed, the exit fluid control valve 10 is closed, and the inlet fluid control valve 8 remains open. The fluid supply system 24 is then back in its operating mode.

During temporary pauses in the operation of the fluid supply system 24, the inlet fluid control valve 8 can be closed and the exit fluid control valve 10 can be opened for a short time and then closed. This operation reduces the pressure of the fluid 14 in the jetting assembly 12 but leaves the accumulator 6 pressurized.

If the fluid supply system 24 is to be shut down for an extended period of time, the motor 34 and the pump head 36 can be disabled, and the inlet and exit fluid control valves 8 and 10 can both be opened. In this state, the fluid 14 in the accumulator 6 flows through the jetting assembly 12 to the "waste" fluid container 26 until accumulator is depleted and the pressure in fluid supply system 24 is at ambient. Both the inlet and exit fluid control valves 8 and 10 can then be closed.

Figure 2A:
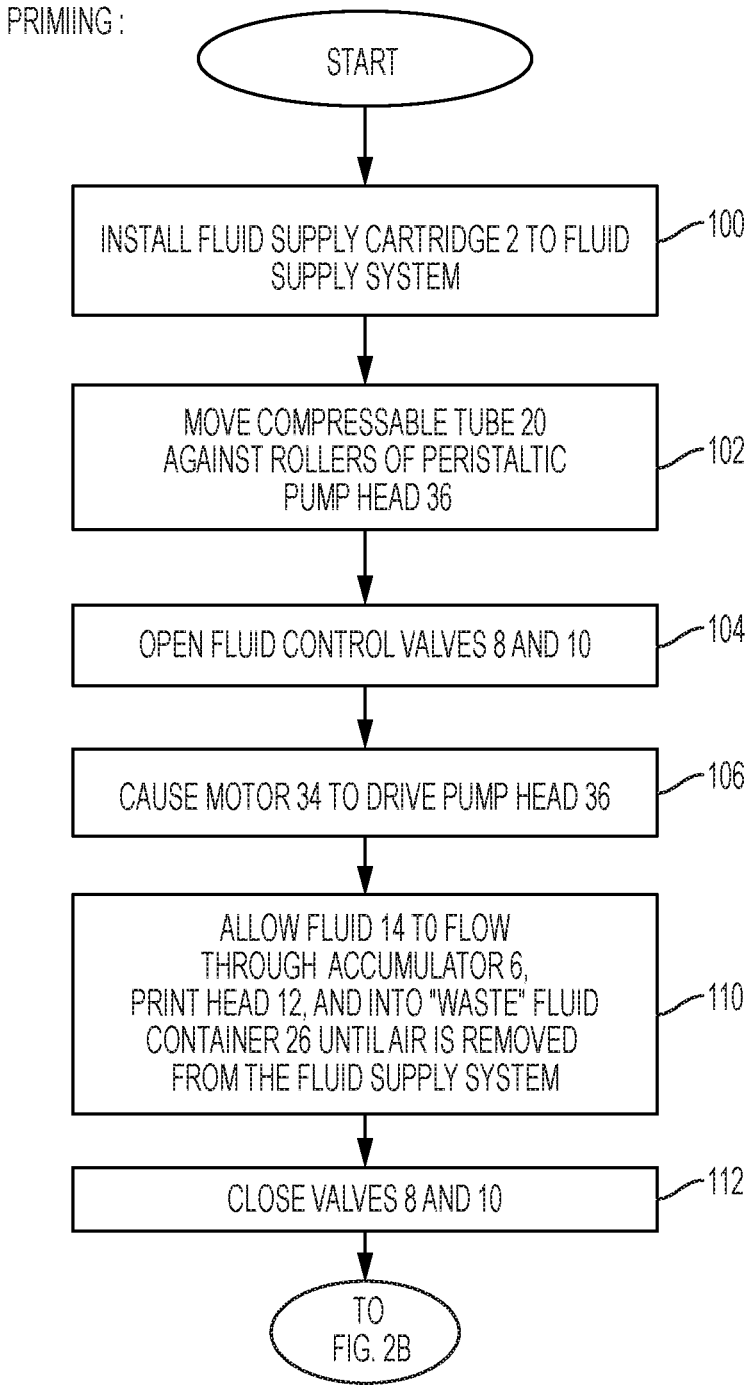
FIG. 2A depicts a flow diagram of an illustrative method of operating the fluid supply system according to an embodiment.
Figure 2B:
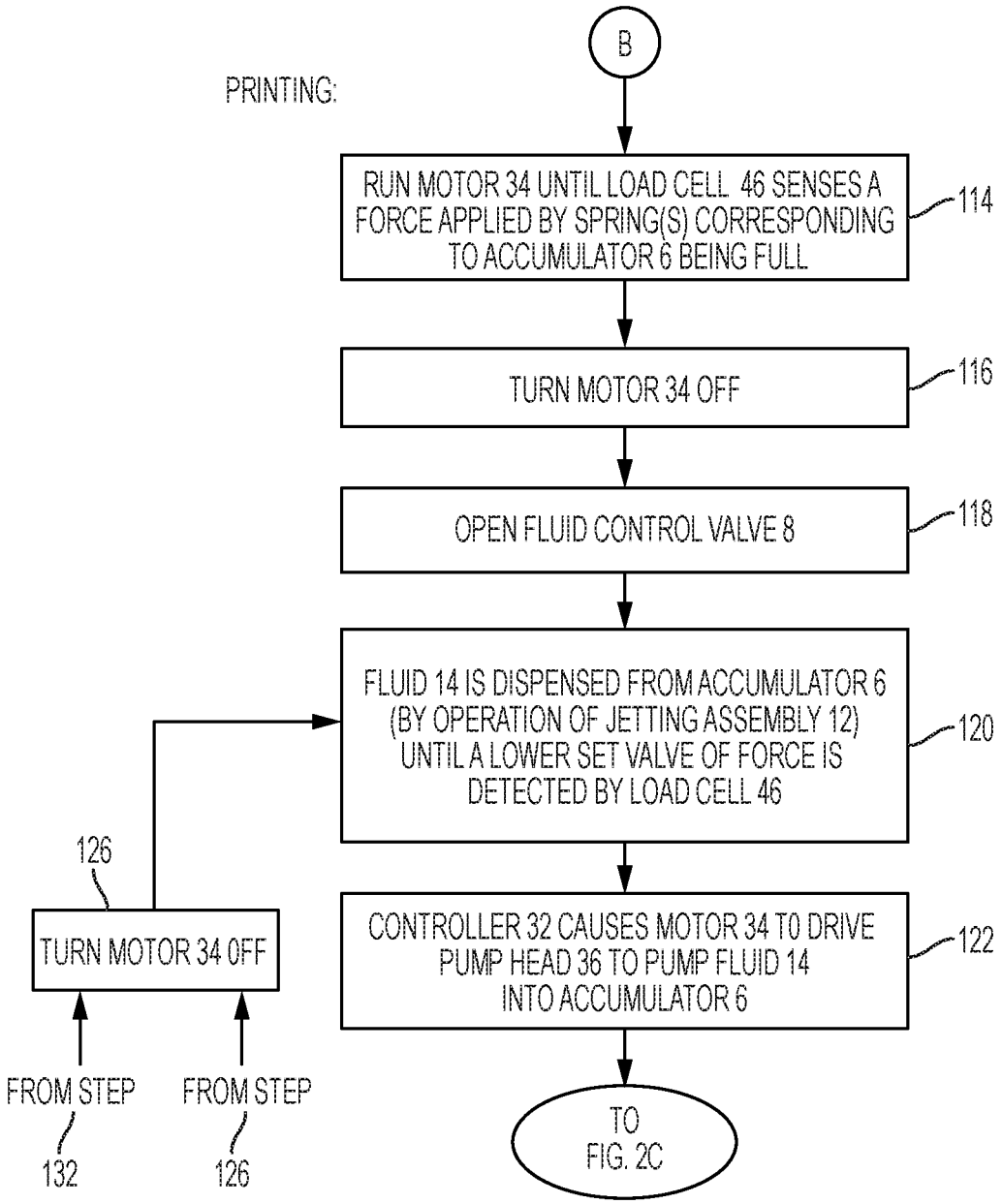
FIG. 2B depicts a flow diagram of an alternate illustrative method of operating the fluid supply system according to an embodiment.
Figure 2C:
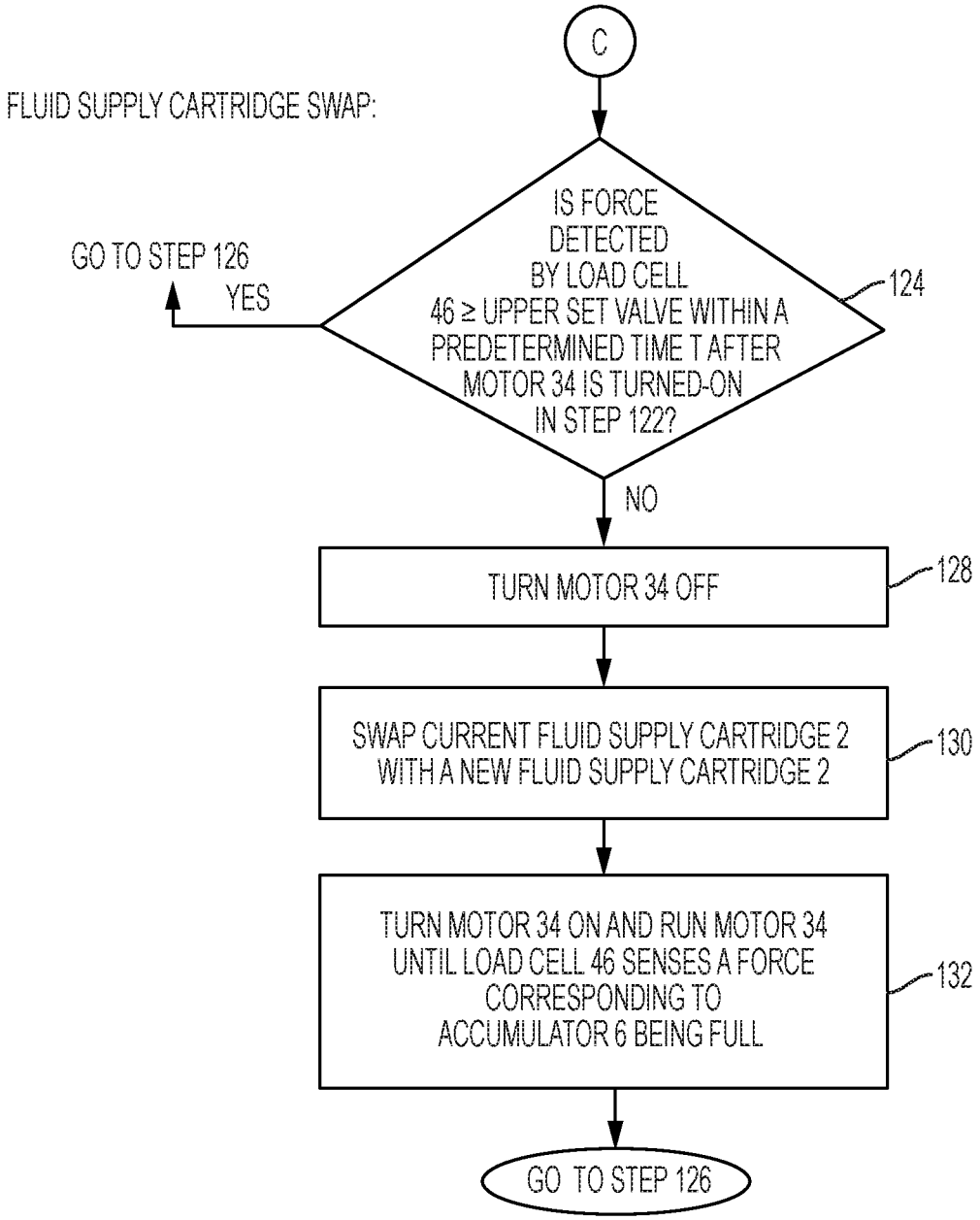
FIG. 2C depicts a flow diagram of yet another alternate illustrative method of operating the fluid supply system according to an embodiment.

Referring to FIGS. 2A-2C and with continuing reference to FIG. 1, an illustrative method of operating the fluid supply system will now be described. However, this illustrative method is not to be construed in a limiting sense.

Priming

Initially, the method advances from a Start step to Step 100 where a fluid supply cartridge 2 is installed via fitments 22 and 28. The method then advances to step 102 where a compressible tube 20 is moved against the rollers of a pump head 36 of a peristaltic pump 4. An ID chip 30 can optionally be read by a processor or controller 32 during this step.

The method then advances to step 104 where inlet and exit fluid control valves 8 and 10 are opened. In step 106, the processor or controller 32 causes the motor 34 to turn on, which, in turn, drives the pump head 36. The method then advances to step 110, where the fluid 14 is allowed to flow through an accumulator 6, a jetting assembly 12, and into a "waste" fluid container 26 until air is removed from the fluid supply system 24. Then, in step 112, the inlet and exit fluid control valves 8 and 10 are closed.

The method then advances to step 114, where the motor 34 is engaged to fill a variable volume 48 until a load cell 46 senses a force applied by a spring(s) 42 which corresponds to a known state in which the accumulator 6 is full. In step 116, the processor or controller 32 causes the motor 34 to turn off.

Printing

Next, in step 118, the inlet fluid control valve 8 is opened, which causes the jetting assembly 12 to dispense fluid 14 from the accumulator 6. In step 120, the fluid 14 is dispensed from the accumulator 6 (in response to the operation of jetting assembly 12) until the force detected by the load cell 46 corresponds to the lower set point force value. The method then advances to step 122, where the processor or controller 32 causes the motor 34 to turn on, thereby causing the pump head 36 to pump the fluid 14 into the accumulator 6.

The method then advances to step 124, where the processor or controller 32 determines whether the force detected by the load cell 46 corresponds to >the upper set point force value within a predetermined time T after the motor 34 is turned on in step 122. If so (YES), the method advances to step 126 in which the processor or controller 32 causes the motor 34 to turn off.

Thereafter, steps 120-126 are repeated until, in an instance of step 124, the processor or controller 32 determines that the force detected by the load cell 46 does NOT correspond to >the upper set point force value within a predetermined time T after the motor 34 is turned on in step 122, i.e., the decision in step 124 is NO—suggesting, in an example, that the current fluid supply cartridge 2 is low or out of fluid 14.

In this case (when the inquiry in the decision in step 124 is NO), the method advances to step 128 where the processor or controller 32 causes the motor 34 to turn off. Next, the method advances to step 130 where the current fluid supply cartridge 2 is replaced with a new fluid supply cartridge 2 including a full charge of the fluid 14. Next, in step 132, the processor or controller 32 causes the motor 34 to turn on and run until the force detected by the load cell 46 corresponds to > to the upper set point force value. In an example, the upper set point force value corresponds to the volume 48 of the accumulator 6 being deemed at pressure, whereupon the method advances to step 126 where the processor or controller 32 causes the motor 34 to turn off. The method then advances to step 120 whereupon the method continues in the manner described above.

In an example, during replacement of the fluid supply cartridge 2 in steps 128-132, the fluid 14 can be supplied by the accumulator 6 to the jetting assembly 12 at a constant pressure or within a desired range of pressures, with the fluid pressure being provided by the spring(s) 42.

As can be seen, the fluid supply system described herein can provide 'hot-swapping' capability of the fluid supply cartridge 2 without interrupting the operation of the jetting assembly 12. The accumulator 6 can be used to accomplish this. The load cell 46 can detect when the accumulator 6 is full and when the accumulator needs to be filled with fluid 14 from the fluid supply cartridge 2.

In a non-limiting example, an accumulator 6 having a volume of approximately 15 mL can provide the jetting assembly 12, in nominal operation, with about 15 minutes of fluid 14 once the fluid supply cartridge 2 is depleted. During this time, the current fluid supply cartridge 2 can be replaced with a new fluid supply cartridge 2 that includes a full charge of fluid 14.

The accumulator 6 can be pressurized with the fluid 14 to a level based on the requirements of the jetting assembly 12. The pressure of the fluid 14 in the accumulator 6 can be controlled to be between desired upper and lower pressures that correspond to the upper and lower set point values programmed into the processor or controller 32.

The load cell 46 can output a voltage that corresponds to the pressure of the fluid 14 in the accumulator 6 to the processor or controller 32. The processor or controller 32 can include circuitry, e.g., an analog to digital converter, that can convert the output of the load cell 46 into a digital equivalent that the processor or controller 32 can compare to the upper and lower set point values for determining when to turn the motor 34 on and off.

The inlet and exit fluid control valves 8 and 10 can be closed to disconnect the fluid 14 flow to the jetting assembly. The inlet and exit fluid control valves 8 and 10 can be opened to allow the jetting assembly 12 to be primed with the fluid 14.

"Waste" fluid used to prime the jetting assembly 12, can be stored in the waste fluid container 26 or a 'diaper' configured to absorb the "waste" fluid.

The fluid supply system can be shipped dry, i.e., without a fluid supply cartridge 2 installed so that an end user may commission the system with any suitable and/or desirable type of fluid 14.

The fluid supply cartridge 2 connection can be configured to 'latch' to the fluid supply system.

Fluid Supply Level Sensing

The manner in which fluid 14 usage can be tracked is described below. The fluid usage tracking allows the amount of fluid left in the fluid supply cartridge 2 to be determined.

In an example, the motor 34 can be a brushless DC motor that includes a number, e.g., three, internal Hall effect sensors, one of which can be used as an internal counter. In an example, the internal Hall effect sensor used as an internal counter can output, for example, 12 pulses per revolution. However, this is not to be construed in a limiting sense because the use of an encoder that outputs any number of pulses per revolution is envisioned.

The number of Hall effect sensor pulses can be used by the processor or controller 32 to increment/decrement a counter in the processor or controller whenever the motor 34 is running. At substantially the same time, the load cell 46 can be monitored for the desired lower and upper pressures.

The amount of fluid 14 moved out of the fluid supply cartridge 2 in one revolution of the peristaltic pump 4 can be determined with reasonable accuracy. By counting the number of revolutions that the peristaltic pump 4 has turned since a new fluid supply cartridge 2 has been installed, the amount of fluid 14 dispensed from the current fluid supply cartridge 2 can be determined. By subtracting the dispensed fluid 14 from the initial volume of fluid in the sealed container 16, the remaining fluid in the sealed container can be calculated or estimated. The amount of fluid 14 used and/or remaining can be stored by the processor or controller 32 in the ID chip 30. This will allow the fluid supply cartridge 2 to be removed and reinstalled at a later time without losing track of the remaining level of fluid 14 in the fluid supply cartridge.

Figure 3:
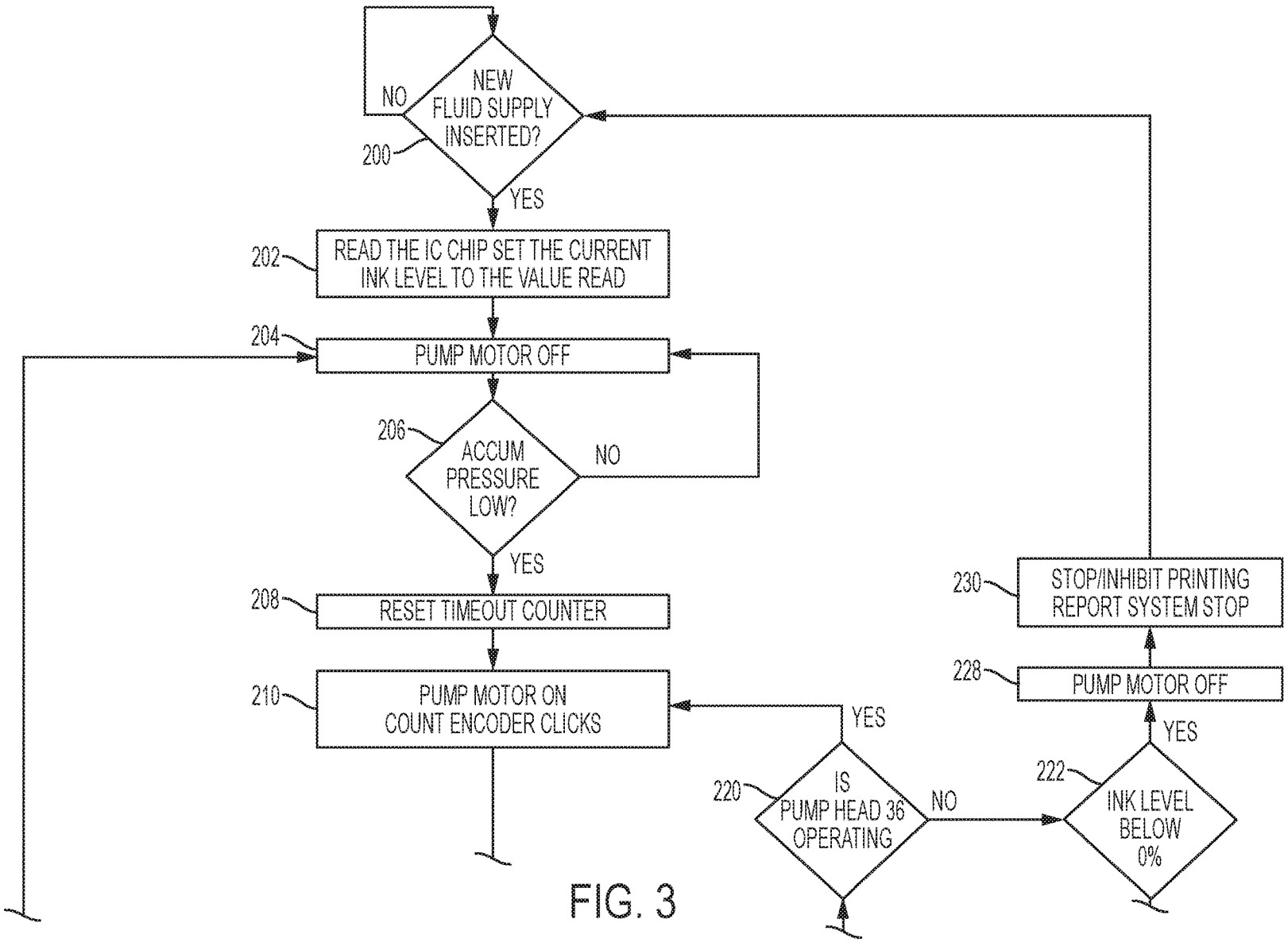
FIG. 3 depicts a flow diagram of still another alternate illustrative method of operating the fluid supply system according to an embodiment.
Figure 3:
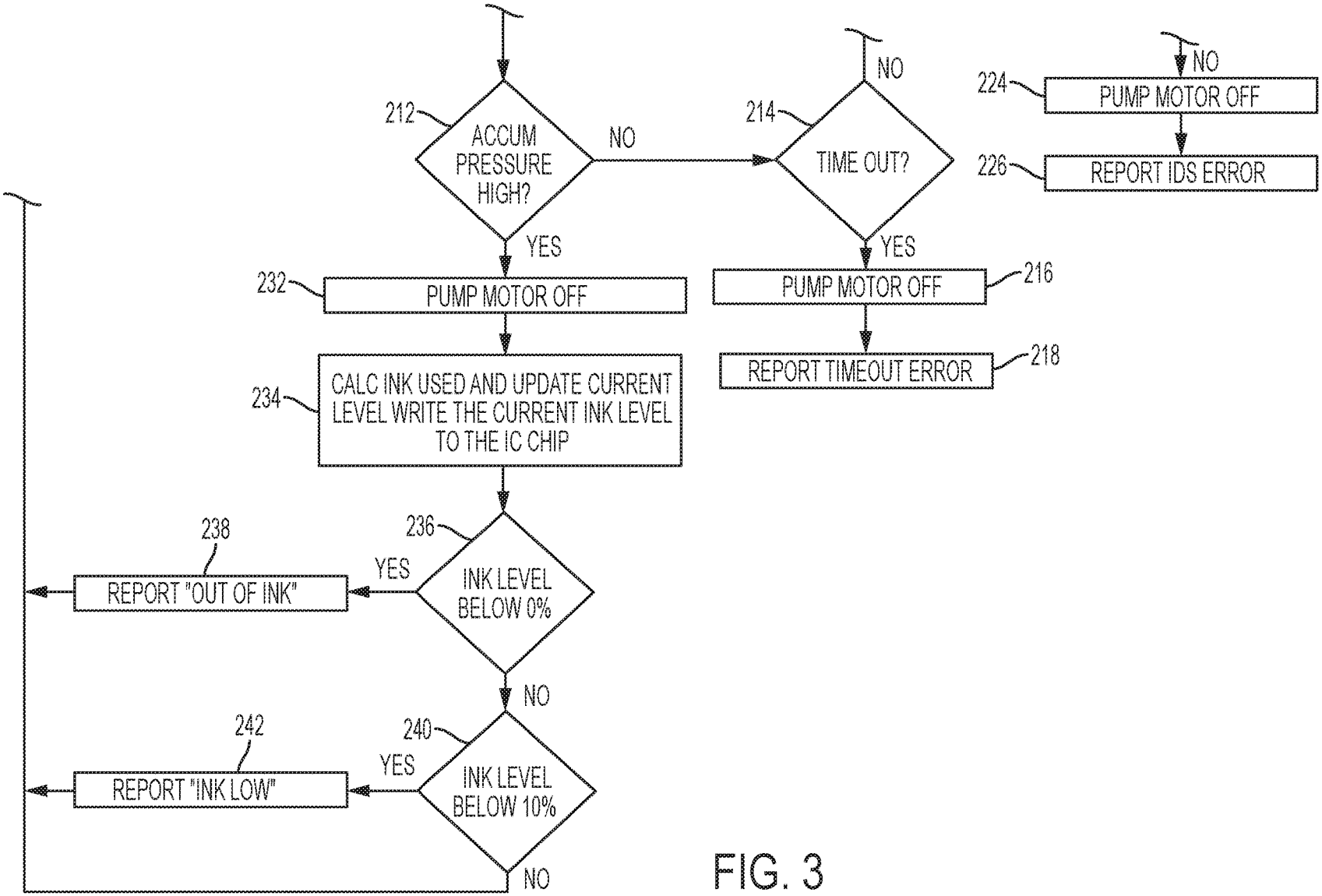

Another method of tracking fluid usage may include controlling the operation of the motor 34 based on fluid usage. Controlling the motor 34 in this manner will now be described with reference to FIG. 3.

The method starts at step 200 where the processor or controller 32 determines if a new fluid supply cartridge 2 has been installed. If not, the method remains at step 200. If, however, the processor or controller 32 determines that a new fluid supply cartridge 2 has been installed, the method advances to step 202. In step 202, the processor or controller 32 reads the current fluid level stored in an ID chip 30 and stores said value in a memory of the processor or controller 32.

The method then advances to step 204 where the processor or controller 32 causes the motor 34 to turn off or remain off. The method then advances to step 206 where the processor or controller 32 determines via the output of the load cell 46 whether the pressure of the fluid 14 in the accumulator 6 is low (below the lower set point force value). If not, the method cycles on steps 204 and 206 until, in an instance of step 206, the processor or controller 32 determines that the pressure of the fluid 14 in the accumulator 6, as determined by the output of the load cell 46, is below the lower set point force value.

If so, the method advances to step 208 where a timeout counter of the processor or controller 32 is reset. Next, the method advances to step 210 where the processor or controller 32 causes the motor 34 to turn on. The processor or controller 32 then begins counting the pulses output by the internal Hall effect sensor of the motor 34.

In step 212, the processor or controller 32 determines whether the output of the load cell 46 is greater than the upper set point force value, which is indicative of the pressure of the fluid 14 in the accumulator 6 being at or above a desired high pressure. If not, the method advances to step 214 where the processor or controller 32 determines whether the timeout counter of the processor or controller 32 has timed out. In this regard, the timeout counter reset in step 208 is incremented periodically by the processor or controller 32.

If in step 214, the processor or controller 32 determines that the timeout counter has timed out, the method advances to steps 216 and 218 in which the motor 34 is turned off, and a timeout error is reported to a user, respectively.

Alternatively, if in step 214, the processor or controller 32 determines that the timeout counter has not timed out, the method advances to step 220 in which the processor or controller 32 determines whether the pump head 36 is still operating. In an example, the processor or controller 32 can determine that the pump head 36 is still operating by sensing that the Hall effect sensor of the motor 34 is outputting pulses.

If, in step 220, the processor or controller 32 determines that the pump head 36 is not operating, the method advances to step 222. In step 222, the processor or controller 32 determines whether the level of fluid 14 in the fluid supply container 2 is below 0% by subtracting the estimated volume of fluid dispensed per revolution of the peristaltic pump 4 from the initial volume of fluid in the fluid supply cartridge 2.

If, in step 222, the processor or controller 32 determines that the fluid level 14 is not below 0%, the method advances to steps 224 and 226 in which the motor 34 is turned off, and an error is reported, respectively.

If, however, in step 222, the processor or controller 32 determines that the fluid level 14 is below 0%, the method advances to steps 228 and 230 in which the motor 34 is turned off and the operation of jetting assembly 12 is stopped or inhibited and a suitable notification is output, respectively. After step 230, the method returns to step 200.

Returning back to step 220, if the processor or controller 32 determines that the pump head 36 is still operating, the method returns to step 210, whereupon steps 210-220 are repeated until, in an instance of step 212, the output of the load cell 46 corresponds to > the upper set point force value indicative of the pressure of the fluid 14 in the accumulator 6 being at a desired upper level. In this case, the method advances from step 212 to step 232 wherein the processor or controller 32 turns off the motor 34.

In step 234, the processor or controller 32 determines the volume of fluid 14 dispensed from the fluid supply cartridge 2 and updates the current level of fluid in the fluid supply cartridge in the ID chip 30. As noted above, the processor or controller 32 can count the revolutions of the peristaltic pump 4, e.g., via an encoder of the peristaltic pump, and can subtract the estimated volume of fluid 14 dispensed per revolution of the peristaltic pump from the initial volume of fluid in the sealed container 16 to determine or calculate the current level of fluid in the fluid supply cartridge 2.

From step 234, the method advances to step 236, where the processor or controller 32 determines whether the level of fluid 14 is below 0%. If so, the method advances to step 238 where the condition of the fluid being below 0% is reported to a user. If, however, in step 236 the processor or controller 32 determines that the fluid level is not below 0%, the method advances to step 240. In step 240, the processor or controller 32 determines whether the fluid level is below 10%. If so, the method advances to step 242 where a suitable indication of a low level fluid is reported to a user. If, however, in step 240 the processor or controller 32 determines that the fluid level is not below 10%, the method returns to step 204. Also, after each of steps 238 and 242, the method returns to step 204.

Upon returning to step 204, the method continues in the manner described above in connection with FIG. 3.

In an example, the processor or controller 32 can track six fluid level states:

1) Fluid supply FULL: no fluid 14 has been pumped out of the sealed container 16.

2) IN USE: The fluid 14 level in the sealed container 16 is determined by count/calculation. Fluid 14 has been pumped out of the fluid supply cartridge 2, either for priming or during normal dispensing operation, e.g. printing. The fluid supply cartridge 2 is now considered IN USE and not FULL. The processor or controller 32 can determine the remaining level of fluid 14 in the sealed container 16 by count/calculation, e.g., counting the revolutions of the peristaltic pump 4 and subtracting (calculating) the estimated volume of fluid 14 dispensed per revolution of the peristaltic pump from the initial volume of fluid in the sealed container 16. This initial volume of fluid in the sealed container 16 can be provided via the ID chip 30 or can be manually input into a user interface (UI) (not shown) of the fluid supply system. In an example, the remaining level of fluid 14 in the sealed container 16 can be displayed in 10% decrements on the UI (not shown). Every time the peristaltic pump 4 is run and then stopped, the processor or controller 32 can determine that the fluid 14 in the accumulator 6 is at a pressure corresponding to the upper set point force value and the volume of fluid remaining in the sealed container 16 can be updated on the ID chip 30.

3) IN USE—FLUID LOW: determined by count/calculation. If priming or normal dispensing operation has consumed all but, for example, 10% of the fluid 14 in the fluid supply cartridge 2, the user is notified via the UI, but normal operation continues.

4) FLUID OUT: determined by count/calculation. If priming and/or normal dispensing operation has consumed all of the fluid 14 in the fluid supply cartridge 2, the user is notified via the UI that the sealed container 16 is empty and the current fluid supply cartridge 2 must be replaced with a new fluid supply cartridge that includes a full charge of fluid or risk poor dispensing (e.g., print) quality and possibly shutdown of the jetting assembly 12. The processor or controller 32 will continue to attempt to fill the accumulator 6 until EMPTY BY COUNT state is reached or EMPTY BY FAULT state is reached.

5) EMPTY BY COUNT: determined by count/calculation. If the counter value is at or below a predetermined FAULT threshold, defined as a count/calculation value below zero—determined, for example, empirically—that occurs if the user does not change the current fluid supply cartridge 2 that is low or out of fluid 14 with a new fluid supply cartridge 2 that includes a full charge of fluid 14, the processor or controller 32 enters a FLUID OUT state. The FLUID OUT state means that the fluid supply system was able to refill the accumulator 6 but further attempts will result in the EMPTY BY FAULT state. This can be a critical fault, whereupon the processor or controller 32 can cause the fluid supply system and, optionally, the jetting assembly 12 to shut down when the accumulator 6 pressure is at or below a predetermined FAULT threshold. The processor or controller 32 can notify the user of the pending shutdown via the UI.

6) EMPTY BY FAULT: This state occurs when the processor or controller 32 does not sense the output of the load cell 46 corresponding to an accumulator 6 full state when attempting to refill the accumulator 6. This means that either the fluid supply cartridge 2 is completely empty of fluid 14 or that the load cell 46 has failed. This is a critical fault, whereupon the processor or controller 32 causes the fluid supply system and, optionally, the jetting assembly 12 to shut down. In an example, the processor or controller 32 can cause the fluid supply system to shut down (i.e., terminate operation of the motor 34) when the output of the load cell 46 corresponds to a predetermined shutdown threshold OR if no pressure change is detected by the load cell in response to operating the motor 34. The processor or controller 32 can notify the user of the pending shutdown via the UI.

Fluid Supply

The fluid supply cartridge 2 can include an internal sealed container 16 in the form of a membrane bag that can carry the fluid 14 and, optionally, a "waste" fluid container 26. The output connections from the fluid supply cartridge 2 to the accumulator 6 can be by septum-type connectors.

The fluid supply cartridge 2 can have a compressible tube 20 that can contact the peristaltic pump rollers, and connect the membrane bag to the output septum. In an example, the membrane bag can be large enough to hold at least 250 mL of fluid 14. The membrane bag and the compressible tube 20 can be configured to accommodate a wide range of fluid types, including MEK.

The fluid supply cartridge 2 can be configured to be resistant to caustic chemicals.

The fluid supply cartridge 2 can latch into the fluid supply system in a way that keeps the fluid supply cartridge securely in place and avoids a 'leaky' connection.

The fluid supply cartridge 2 can include an ID chip 30 that can store encrypted fluid related information and be used for fluid protection. Illustrative data includes, but is not limited to, a volume of the sealed container 16; a type of fluid 14; firing parameters for one or more micro-valves of the jetting assembly 12; an amount of fluid remaining; a container ID; a license code; a manufacturing date code; and/or a full/empty code.

The ID chip 30 can connect to the processor or controller 32 through a hardwired connector 60 via a communications bus. In an example, the communication bus can be an I2C communication bus. In an example, the ID chip 30 can have 1 Kbyte of memory and have a minimum of 10,000 write cycles.

In an example, the fluid supply container 2 can include an optional "waste" fluid container 26 or 'diaper' to absorb waste fluid from priming the jetting assembly 12.

In an embodiment, the connection to the optional "waste" fluid container 26 or 'diaper' can be a septum-type connector.

The foregoing examples have been described with reference to the accompanying figures. Modifications and alterations will occur to others upon reading and understanding the foregoing examples. Accordingly, the foregoing examples are not to be construed as limiting the disclosure.

What is claimed is:

1. A fluid supply system comprising:

a variable volume accumulator configured to receive a fluid from a fluid supply source; and a pump for transferring the fluid from the fluid supply source into the variable volume accumulator, wherein the variable volume accumulator is configured to output the fluid between a first pressure and a second pressure to a jetting assembly and the first pressure is greater than the second pressure.

2. The fluid supply system of claim 1, wherein when outputting the fluid at the first pressure, the variable volume accumulator holds a first volume of the fluid, and when outputting the fluid at the second pressure, the variable volume accumulator holds a second volume of the fluid, and the second volume of the fluid is less than the first volume of the fluid.

3. The fluid supply system of claim 1, wherein the volume of the variable volume accumulator increases in response to the transfer of the fluid into the variable volume accumulator.

4. The fluid supply system of claim 1, wherein the volume of the variable volume accumulator decreases in response to outputting the fluid to the jetting assembly.

5. The fluid supply system of claim 1, wherein the fluid supply source is a replaceable fluid supply source, and wherein the jetting assembly operates uninterrupted during replacement of the replaceable fluid supply source.

6. The fluid supply system of claim 1, wherein the fluid supply source is a replaceable fluid supply source, and wherein the variable volume accumulator is capable of supplying all of the fluid required by normal operation of the jetting assembly during the time required to replace the replaceable fluid supply source.

7. A fluid supply system comprising:

a peristaltic pump that transfers a fluid by pushing the fluid through a compressible tube, and a replaceable fluid supply source that includes the fluid, and wherein the compressible tube is associated with the replaceable fluid supply source so as to be removed from the fluid supply system when the replaceable fluid supply source is replaced, and a waste fluid container configured to store waste fluid when the replaceable fluid supply source is replaced.

8. The fluid supply system of claim 7, further comprising a jetting assembly, wherein the jetting assembly operates uninterrupted during replacement of the replaceable fluid supply source.

9. The fluid supply system of claim 7, further comprising a jetting assembly and a variable volume accumulator configured to receive the fluid from the replaceable fluid supply source.

10. The fluid supply system of claim 7, wherein an amount of the fluid within the replaceable fluid supply source is less than or equal to a wear lifetime of the compressible tube.

11. A method of supplying fluid comprising:

transferring a fluid with a pump from a fluid supply source into a variable volume accumulator that is configured to receive the fluid from the fluid supply source; and outputting, from the variable volume accumulator to a jetting assembly, the fluid between a first pressure and a second pressure, wherein the first pressure is greater than the second pressure.

12. The method of claim 11, wherein the variable volume accumulator holds a first volume of the fluid, and during outputting the fluid at the second pressure, the variable volume accumulator holds a second volume of the fluid, and the second volume of the fluid is less than the first volume of the fluid.

13. The method of claim 11, wherein the fluid supply source is a replaceable fluid supply source, and further comprising:

replacing the replaceable fluid supply source, and operating the jetting assembly uninterrupted during the replacing of the replaceable fluid supply source.

14. A method of supplying fluid comprising:

providing a peristaltic pump, and providing a replaceable fluid supply source that includes a fluid, and transferring the fluid using the peristaltic pump by pushing the fluid through a compressible tube, wherein the compressible tube is associated with the replaceable fluid supply source so as to be removed from a fluid supply system when the replaceable fluid supply source is replaced, and providing a waste fluid container that stores waste fluid when the replaceable fluid supply source is replaced.

15. The method of claim 14, further comprising replacing the replaceable fluid supply source.

16. The method of claim 15, further comprising operating the jetting assembly uninterrupted during the replacing of the replaceable fluid supply source.

* * * * *